US010619342B2

(12) United States Patent
Zavitz et al.

(10) Patent No.: US 10,619,342 B2
(45) Date of Patent: Apr. 14, 2020

(54) METHODS AND APPARATUSES FOR CONSTRUCTING A CONCRETE STRUCTURE

(71) Applicant: Tindall Corporation, Spartanburg, SC (US)

(72) Inventors: Bryant Zavitz, Dunwoody, GA (US); Kevin Kirkley, Dunwoody, GA (US); Chris Sigmon, Atlanta, GA (US); Michael Willis, Atlanta, GA (US); Behnam Naji, Atlanta, GA (US)

(73) Assignee: Tindall Corporation, Spartanburg, SC (US)

( * ) Notice: Subject to any disclaimer, the term of this patent is extended or adjusted under 35 U.S.C. 154(b) by 0 days.

(21) Appl. No.: 15/897,830

(22) Filed: Feb. 15, 2018

(65) Prior Publication Data

US 2018/0291612 A1 Oct. 11, 2018

Related U.S. Application Data

(60) Provisional application No. 62/459,060, filed on Feb. 15, 2017.

(51) Int. Cl.
*E04B 1/21* (2006.01)
*E04B 1/41* (2006.01)
(Continued)

(52) U.S. Cl.
CPC ..... *E04B 1/21* (2013.01); *E04B 1/4157* (2013.01); *E04B 1/5837* (2013.01);
(Continued)

(58) Field of Classification Search
CPC ..... E04B 1/21; E04B 1/4157; E04B 1/5837; E04B 2103/02; E04C 5/0622; E04C 5/165; E04C 5/0645
(Continued)

(56) References Cited

U.S. PATENT DOCUMENTS 960,125 A * 5/1910 Tresidder ..... E04B 1/185 52/283
1,050,130 A * 1/1913 Harvey ..... E04B 5/023 52/583.1
(Continued)

FOREIGN PATENT DOCUMENTS

DE 1784807 A1 * 11/1971 ..... E04C 5/165
FR 1283969 A * 2/1962 ..... E04B 1/21
(Continued)

OTHER PUBLICATIONS

Supplemental Notice of Allowance, dated Jun. 20, 2018, in connection with U.S. Appl. No. 15/236,440.
(Continued)

*Primary Examiner* — Patrick J Maestri
*Assistant Examiner* — Joseph J. Sadlon
(74) *Attorney, Agent, or Firm* — Meunier Carlin & Curfman LLC

(57) ABSTRACT

Various implementations include methods and apparatuses for constructing a concrete structure. In one implementation, a structure includes a pre-cast concrete column section and a pre-cast concrete beam section. The column section includes an embedded first assembly with a threaded rod, and the beam section includes an embedded second assembly defining a channel for receiving the threaded rod. Grout is fed through a joint between the column and beam sections into the second assembly to couple the threaded rod with the second assembly. The grout is urged through the joint and the second assembly by gravity and by applying vacuum suction to a grout port defined by the second assembly. The grout port extends between the channel of the second assembly and an external face of the beam section.

19 Claims, 14 Drawing Sheets

(51) Int. Cl.
*E04B 1/58* (2006.01)
*E04C 5/06* (2006.01)
*E04C 5/16* (2006.01)

(52) U.S. Cl.
CPC ..... *E04C 5/0622* (2013.01); *E04C 5/0645* (2013.01); *E04C 5/165* (2013.01); *E04B 2103/02* (2013.01)

(58) Field of Classification Search
USPC ..... 52/650.1, 648.1
See application file for complete search history.

(56) References Cited

U.S. PATENT DOCUMENTS 2,569,669 A * 10/1951 Henderson ..... E04B 1/21 52/283
2,724,261 A * 11/1955 Rensaa ..... E04B 1/0007 52/259
2,948,995 A * 8/1960 Cogan ..... E04B 1/21 264/228
3,245,190 A 4/1966 Reiland
3,369,334 A 2/1968 Berg
3,540,763 A * 11/1970 Yee ..... F16G 11/00 403/265
3,613,325 A * 10/1971 Yee ..... E04B 1/20 52/236.8
3,621,626 A 11/1971 Tylius
3,722,159 A * 3/1973 Kessler ..... E04B 1/215 52/252
3,782,061 A 1/1974 Minutoli
3,921,281 A * 11/1975 Hattori ..... B21D 39/046 29/520
3,965,627 A 6/1976 Fencl
3,971,179 A * 7/1976 Bodocsi ..... E04B 1/24 52/223.11
4,024,688 A 5/1977 Calini
4,028,857 A * 6/1977 Fischer ..... E04B 1/41 52/309.2
4,067,224 A * 1/1978 Birks ..... B21F 15/06 29/517
4,075,801 A * 2/1978 Alper ..... E04H 7/20 52/196
4,094,054 A * 6/1978 Fischer ..... E04B 1/41 29/460
4,099,360 A 7/1978 Outram
4,185,440 A * 1/1980 Finsterwalder ..... B28B 23/046 264/228
4,205,029 A * 5/1980 Forrest ..... B28B 23/046 264/228
4,627,212 A * 12/1986 Yee ..... E04C 5/165 285/294.1
4,692,052 A * 9/1987 Yee ..... E04C 5/163 403/13
4,694,621 A 9/1987 Locke
4,951,438 A * 8/1990 Thoresen ..... E04B 1/215 403/187
5,012,622 A * 5/1991 Sato ..... E02D 5/30 52/263
5,030,052 A * 7/1991 Anderson ..... E04G 23/02 411/383
5,050,364 A * 9/1991 Johnson ..... E04B 1/4157 52/295
5,090,172 A * 2/1992 Chana ..... E04C 5/0645 52/252
5,123,220 A 6/1992 Simenoff
5,152,118 A 10/1992 Lancelot
5,261,198 A 11/1993 McMillan
5,289,626 A * 3/1994 Mochida ..... E02D 5/76 29/452
5,305,573 A * 4/1994 Baumann ..... E04C 5/165 403/305
5,308,184 A 5/1994 Bernard
5,366,672 A 11/1994 Albrigo et al.
5,383,740 A * 1/1995 Lancelot, III ..... E04C 5/165 403/267
5,410,847 A * 5/1995 Okawa ..... E04B 1/30 403/346
5,561,956 A 10/1996 Englekirk et al.
5,606,839 A 3/1997 Baumann
5,732,525 A * 3/1998 Mochizuki ..... E04C 5/165 403/269
5,974,761 A 11/1999 Mochizuki et al.
6,003,281 A * 12/1999 Pilakoutas ..... E04C 5/0645 52/414
6,065,263 A 5/2000 Taguchi
6,195,949 B1 3/2001 Schuyler
6,212,847 B1 * 4/2001 Park ..... B29C 45/14344 29/897.312
6,286,270 B1 * 9/2001 Gruson ..... E04C 5/03 52/155
6,295,770 B1 * 10/2001 Sheu ..... E04B 1/161 52/167.1
6,192,647 B1 12/2001 Dahl
6,327,829 B1 12/2001 Taguchi
6,381,912 B1 * 5/2002 Sorkin ..... E04C 5/08 24/459
6,622,442 B2 * 9/2003 Kwon ..... E01D 19/125 403/348
6,631,592 B1 * 10/2003 Hancock ..... E04C 5/165 403/305
6,647,678 B1 * 11/2003 Zambelli ..... E04B 1/22 52/167.3
6,735,994 B2 * 5/2004 Buhler ..... B21F 5/00 72/20.1
6,880,224 B2 * 4/2005 Colarusso ..... B21O 5/00 29/456
6,883,998 B2 * 4/2005 Bullivant ..... E04C 5/07 403/300
7,010,891 B1 * 3/2006 Clark ..... B28B 15/005 52/125.5
7,938,379 B2 * 5/2011 Baten ..... F16M 5/00 248/674
8,359,797 B2 * 1/2013 Lee ..... E04B 1/04 249/19
8,375,678 B1 2/2013 Ferrer
8,656,680 B2 * 2/2014 James ..... E21D 20/028 405/259.5
8,943,776 B2 * 2/2015 Strickland ..... E04B 5/29 52/250
8,973,317 B2 * 3/2015 Larkin ..... E04B 1/7608 52/223.14
9,057,170 B2 * 6/2015 Tadros ..... E02D 5/523
9,404,258 B2 * 8/2016 Yun ..... E04C 5/165
9,410,316 B2 8/2016 Reigstad
9,410,320 B2 * 8/2016 Murata ..... E04C 5/0604
9,410,322 B1 * 8/2016 Du ..... B66C 23/342 52/745.19
9,534,411 B2 * 1/2017 Kurosawa ..... E04C 5/012
9,644,369 B2 * 5/2017 Reigstad ..... E04B 5/023
9,677,274 B2 6/2017 Saiidi
10,378,199 B2 * 8/2019 Calderon Uriszar-Aldaca ..... E02D 27/34 52/655.1
10,465,374 B2 * 11/2019 Sugaya ..... E04B 1/04 249/19
2004/0182016 A1 9/2004 Locke
2007/0261356 A1 * 11/2007 Vaughn ..... E02D 27/34 52/655.1
2008/0222976 A1 9/2008 Liskey
2008/0236090 A1 10/2008 Liberman
2009/0022545 A1 1/2009 Koivunen
2009/0094915 A1 4/2009 Liberman
2011/0061336 A1 * 3/2011 Thomas ..... B66C 23/342 52/745.19
2011/0308198 A1 12/2011 Comeford
2012/0110928 A1 5/2012 Liberman
2012/0210656 A1 8/2012 Hernandez et al.
2014/0123573 A1 5/2014 Fransworth
2015/0176278 A1 6/2015 Reigstad

(56) References Cited

U.S. PATENT DOCUMENTS

| | | | | |
|---|---|---|---|---|
| 2016/0097199 | A1 | 4/2016 | Saiidi | |
| 2017/0051495 | A1 | 2/2017 | Zavitz | |
| 2017/0175376 | A1 | 6/2017 | Calderon et al. | |
| 2017/0204608 | A1 * | 7/2017 | Yang | E04C 5/16 |
| 2017/0247844 | A1 | 8/2017 | Saiidi | |
| 2017/0356177 | A1 | 12/2017 | Lee et al. | |

FOREIGN PATENT DOCUMENTS

| | | | | |
|---|---|---|---|---|
| FR | 2349009 | A1 * | 11/1977 | E02D 5/523 |
| FR | 2438719 | A1 * | 5/1980 | E04B 1/21 |
| FR | 2491977 | A1 * | 4/1982 | E04B 1/21 |
| GB | 2503228 | A1 | 12/2013 | |
| KR | 101451168 | B1 * | 10/2014 | |
| WO | 2014/118713 | A1 | 8/2014 | |
| WO | 2016111513 | A1 | 4/2016 | |
| WO | 2017031136 | A1 | 2/2017 | |

OTHER PUBLICATIONS

International Search Report and Written Opinion issued for International Application No. PCT/US2018/018391, dated May 4, 2018.

International Search Report and Written Opinion issued for International Application No. PCT/US2016/047228, dated Nov. 15, 2016.

Office Action issued in co-pending U.S. Appl. No. 15/236,440, dated Mar. 13, 2017.

Office Action issued in co-pending U.S. Appl. No. 15/236,440, dated Oct. 13, 2017.

Notice of Allowance issued in co-pending U.S. Appl. No. 15/236,440, dated Mar. 12, 2018.

Extended European Search Report issued in European Application No. 16837712, dated Mar. 26, 2019, 8 pages.

* cited by examiner

METHODS AND APPARATUSES FOR CONSTRUCTING A CONCRETE STRUCTURE

CROSS REFERENCE TO RELATED APPLICATIONS

This application claims priority to U.S. Provisional Patent Application No. 62/459,060, entitled "METHOD AND APPARATUS FOR CONSTRUCTING A CONCRETE STRUCTURE," filed Feb. 15, 2017, which is incorporated by reference herein in its entirety.

BACKGROUND

Conventional methods and apparatuses for constructing a structure with field poured components can be labor and time intensive. The use of pre-cast elements is desired, but it can lead to a weaker structure than can be attained with field poured elements. Accordingly, a more efficient method and apparatus for constructing stronger structures with pre-cast concrete elements is needed.

SUMMARY

Various implementations broadly comprise methods and apparatuses for constructing a concrete structure. In one implementation, a structure includes a pre-cast concrete column section and a pre-cast concrete beam section. The column section includes an embedded first assembly with a threaded rod, and the beam section includes an embedded second assembly defining a channel for receiving the threaded rod. Methods and apparatuses are disclosed herein for producing a structural joint between the column and beam sections.

Various implementations include a method of assembling a structure. The method includes: (1) providing a pre-cast concrete column section having at least one embedded first assembly, each embedded first assembly including at least one threaded rod, each threaded rod having a first portion and a second portion, wherein the second portion is between the first portion and a distal end of the threaded rod: (2) bringing a pre-cast concrete beam section near the column section, the beam section having at least one embedded second assembly defining a channel for receiving the distal end and second portion of the threaded rod and at least one grout port extending between the channel and an external surface of the beam section; (3) rotating the first portion of the threaded rod about its axis within the first assembly until the distal end and second portion of the threaded rod extend axially into the channel defined in the second assembly; (4) coupling a frame around at least a portion of a joint between the column section and the beam section; (5) after rotating the first portion of the threaded rod and coupling the frame over the joint, feeding grout into the joint while applying vacuum suction to the at least one grout port, the vacuum suction causing grout to flow through the joint, the channel, and the grout port of the second assembly; and (6) removing the frame after the grout dries, wherein the second portion and distal end of the threaded rod are held within the channel only by the grout.

In some implementations, the second assembly is coupled to a rebar extending axially through the beam section.

In some implementations, the method further comprises coupling a corbel to the column section prior to bringing the beam section in close proximity to the column section, and setting a lower face of the beam section onto the corbel prior to rotating the threaded rod of the first assembly.

In some implementations, the column section includes two or more first embedded assemblies and the beam section includes two or more corresponding embedded second assemblies that are axially alignable with the first assemblies.

In some implementations, the method further comprises coupling a lower portion of the column section to a foundation prior to bringing the beam section in close proximity to the column section.

In some implementations, the method further comprises coupling a lower portion of the column section to an upper portion of another column section prior to bringing the beam section in close proximity to the column section.

In some implementations, the beam section is a first beam section and is brought in close proximity to a first face of the column section, and the method further comprises bringing a second beam section in close proximity to a second face of the column section, the second face being opposite and spaced apart from the first face. And, in certain implementations, the threaded rod is a first threaded rod extendable from a first end of the first assembly in a first axial direction into the channel of the second assembly of the first beam section, and the first assembly further comprises a second threaded rod extendable from a second end of the assembly in a second axial direction into the channel of the second assembly of the second beam section, wherein the first and second axial directions are opposite each other.

In some implementations, the beam section is a first beam section and is brought in close proximity to a first face of the column section, and the method further comprises bringing a second beam section in close proximity to a second face of the column section, the second face being adjacent to the first face.

In some implementations, the beam section includes a shear lug, and the method further comprises extending the shear lug into a channel defined in the column section.

Various other implementations include system for assembling a structure. The system includes a pre-cast concrete column section, a pre-cast concrete beam section, and a frame. The pre-cast concrete column section includes an embedded first assembly with at least one threaded rod, each threaded rod having a first portion and a second portion, wherein the first portion is rotatable within the embedded first assembly to extend the second portion of the threaded rod out of the embedded first assembly. The pre-cast concrete beam section comprises an embedded second assembly defining a channel for receiving the second portion of the threaded rod and at least one grout port, the at least one grout port extending from the channel to an external face of the beam section. The frame extends around at least a portion of a joint defined between the column section and the beam section, wherein the frame defines an opening along an upper edge of the beam section. And, the at least one grout port is couplable to a vacuum suction source for applying vacuum suction to the grout port to urge grout poured into the opening of the frame to flow through the joint and through the second assembly and into the grout port. The second portion of the threaded rod is held within the channel only by the grout and does not engage any threaded structure within the channel.

In some implementations, the second assembly in the beam section is coupled to a rebar in the beam section.

In some implementations, the beam section includes a shear lug configured to be inserted into a channel defined in the column section.

In some implementations, the column section includes two or more first assemblies, and the beam section includes two or more corresponding second assemblies defining channels for receiving the threaded rods.

In some implementations a lower portion of the column section is connected to a foundation.

In some implementations, a lower portion of the column section is connected to another column section.

In some implementations, the beam section is a first beam section coupled to a first face of the column section, and the system further comprises a second beam section coupled to a second face of the column section, wherein the first face is opposite and spaced apart from the second face. In certain implementations, the threaded rod is a first threaded rod extendable from a first end of the first assembly in a first axial direction into the channel of the second assembly of the first beam section, and the first assembly further comprises a second threaded rod extendable from a second end of the assembly in a second axial direction into the channel of the second assembly of the second beam section, wherein the first and second axial directions are opposite each other.

In some implementations, the beam section is a first beam section coupled to a first face of the column section, and the system further comprises a second beam section coupled to a second face of the column section, wherein the first face is adjacent to the second face.

BRIEF DESCRIPTION OF THE DRAWINGS

A full and enabling disclosure of the present subject matter is set forth in the specification, which makes reference to the appended figures. In the figures, an internal view of least a portion of the structure may be shown to allow embedded portions of the structure to be illustrated.

DETAILED DESCRIPTION

Reference is presently made in detail to example implementations that are illustrated in or represented by the drawings. Each example is provided by way of explanation of the present subject matter, not as a limitation of the present subject matter. In fact, it will be apparent to those skilled in the art that various modifications and variations can be made in the present subject matter without departing from the scope or spirit of the present subject matter. For instance, features illustrated or described as part of one implementation can be used with another implementation to yield a still further implementation. Thus, it is intended that the present subject matter covers such modifications and variations as come within the scope of the disclosure and equivalents thereof.

Figure 1:
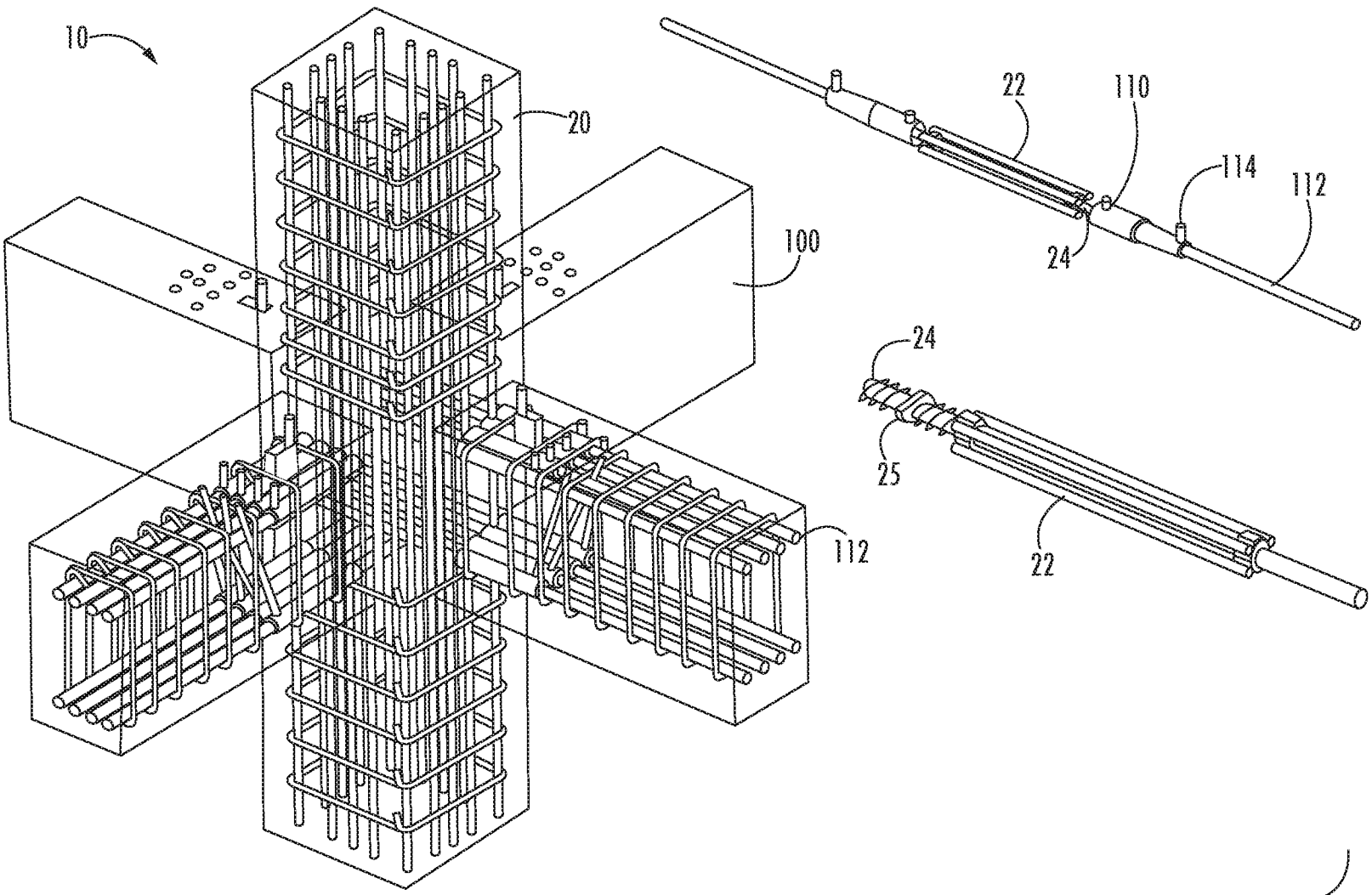
FIG. 1 illustrates a perspective view of a concrete structure and exploded views of assemblies embedded therein, according to one implementation. An internal view of two beams and a column are shown, and an external view of two beams are shown.
Figure 4:
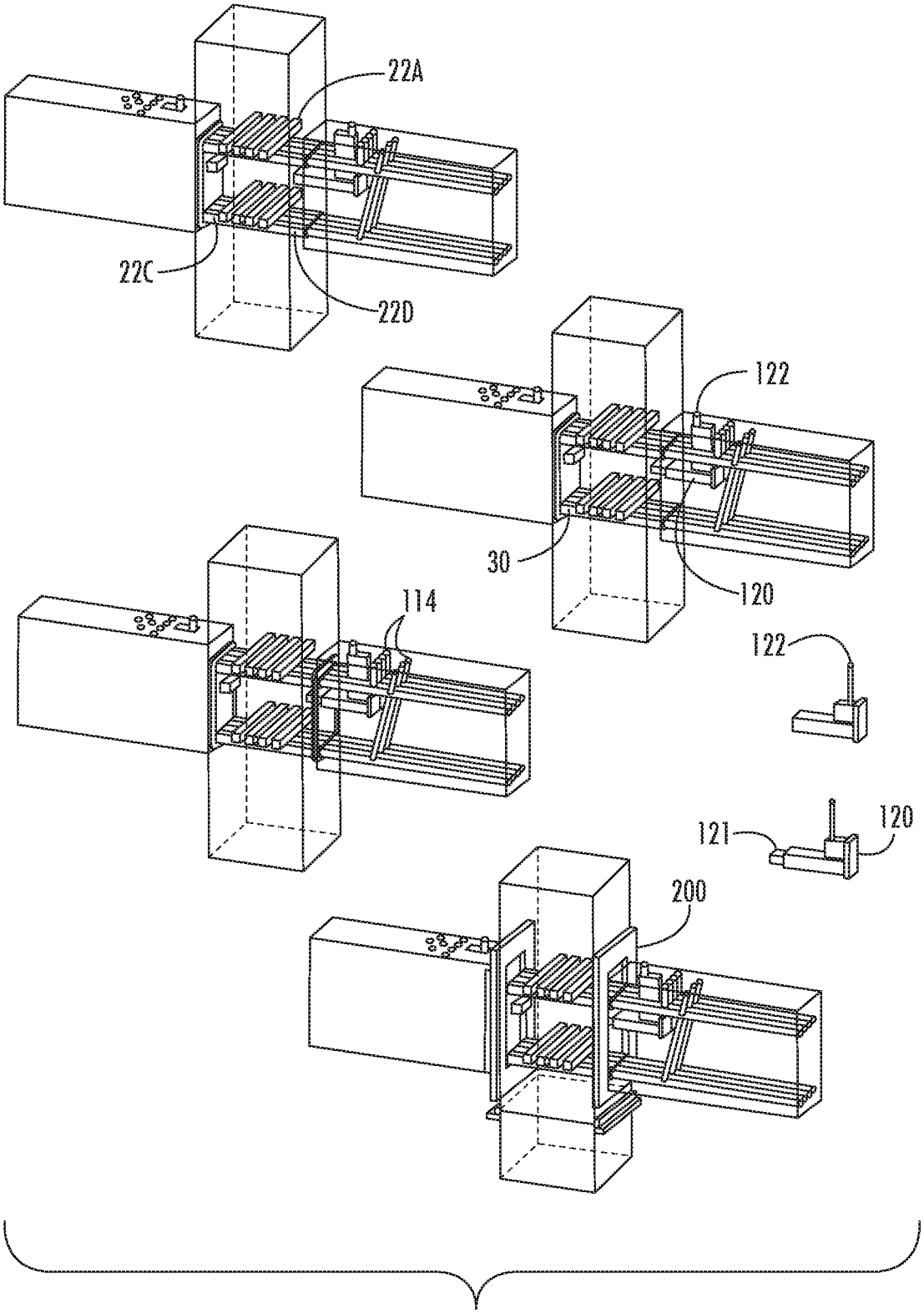
FIGS. 4 and 5A-5E illustrate an example process for assembling a portion of the structure shown in FIG. 1.
Figure 5B:
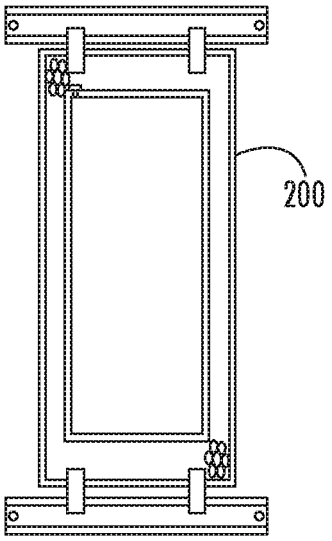
Figure 5C:
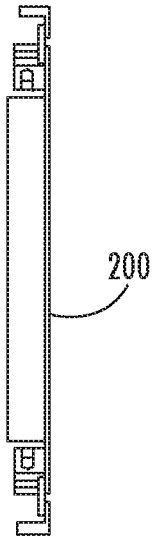
Figure 5D:
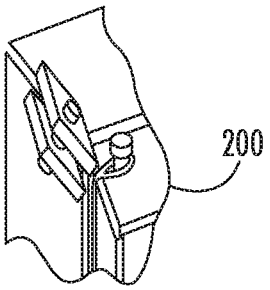
Figure 5A:
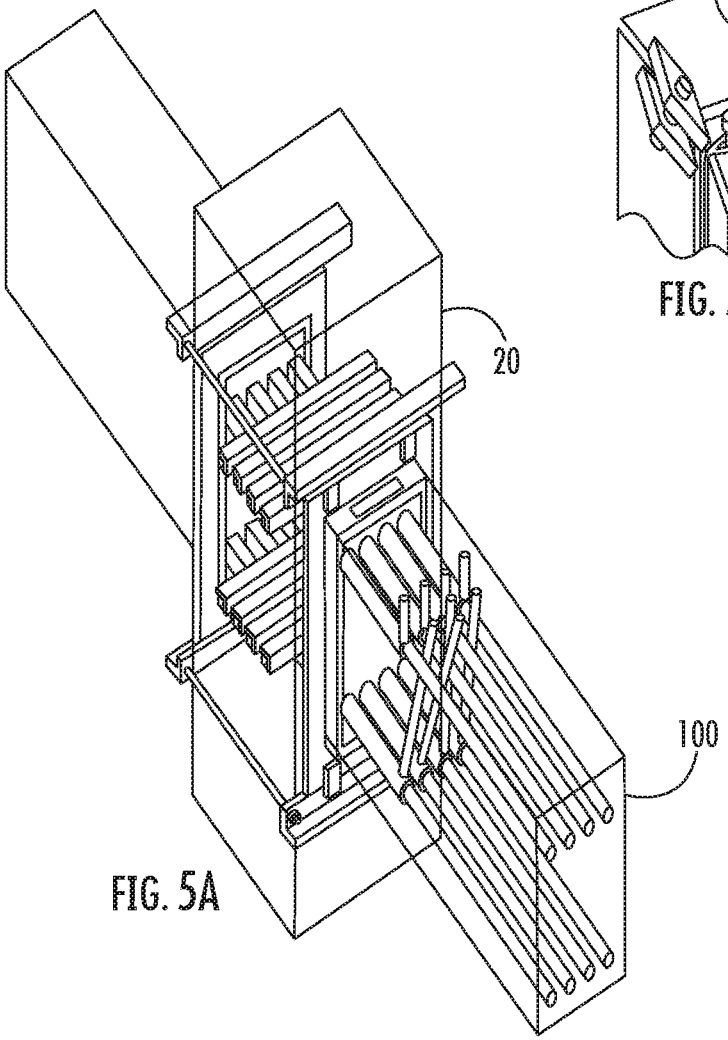
Figure 5E:
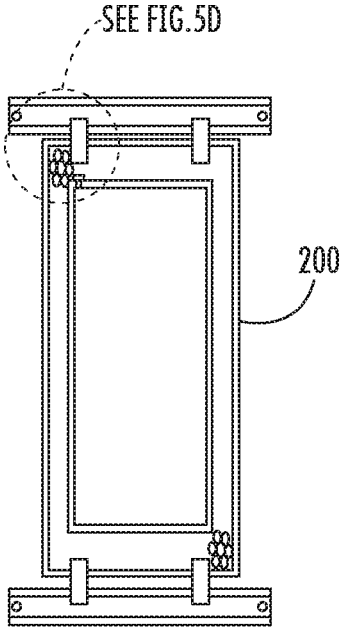
Figure 18:
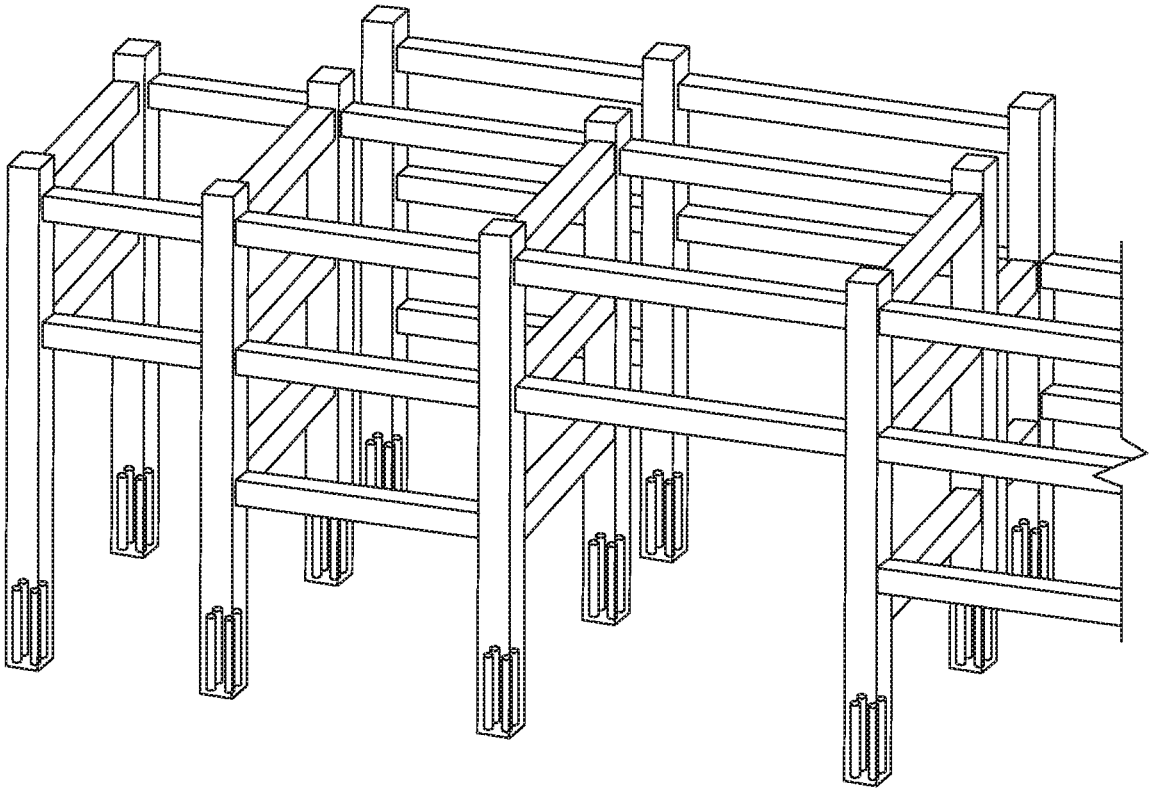
FIG. 18 illustrates a perspective view of a plurality of column sections and beam sections assembled to the column sections at various elevations, according to another implementation.

FIG. 1 shows a structure 10 built according to one implementation. Structure 10 includes a column section 20 and four beam sections 100 coupled to each face of the column section 20 at one elevation. However, other implementations may include structures with one or more beam sections 100 connected to column section 20 at one elevation and structures with one or more beam sections 100 coupled to the column sections 20 at various elevations. For example, one implementation includes two beam sections 100 coupled to adjacent sides of column section 20, and another implementation includes two beam sections 100 connected to opposite sides of column section 20 (as shown in FIGS. 4 and 5). And, in some implementations, such as shown in FIG. 18, the structure includes multiple column sections and beam sections coupled together at various elevations.

Structure 10 may be used in any type of concrete structure, for example, buildings, parking garages, and industrial structures. Columns in the interior of structures may have beams connected to all four sides at each elevation (e.g., floor), while corner columns may have only two beams connected to adjacent sides of a column at each elevation, and side columns may have only two or three beams attached to each elevation.

Figure 2:
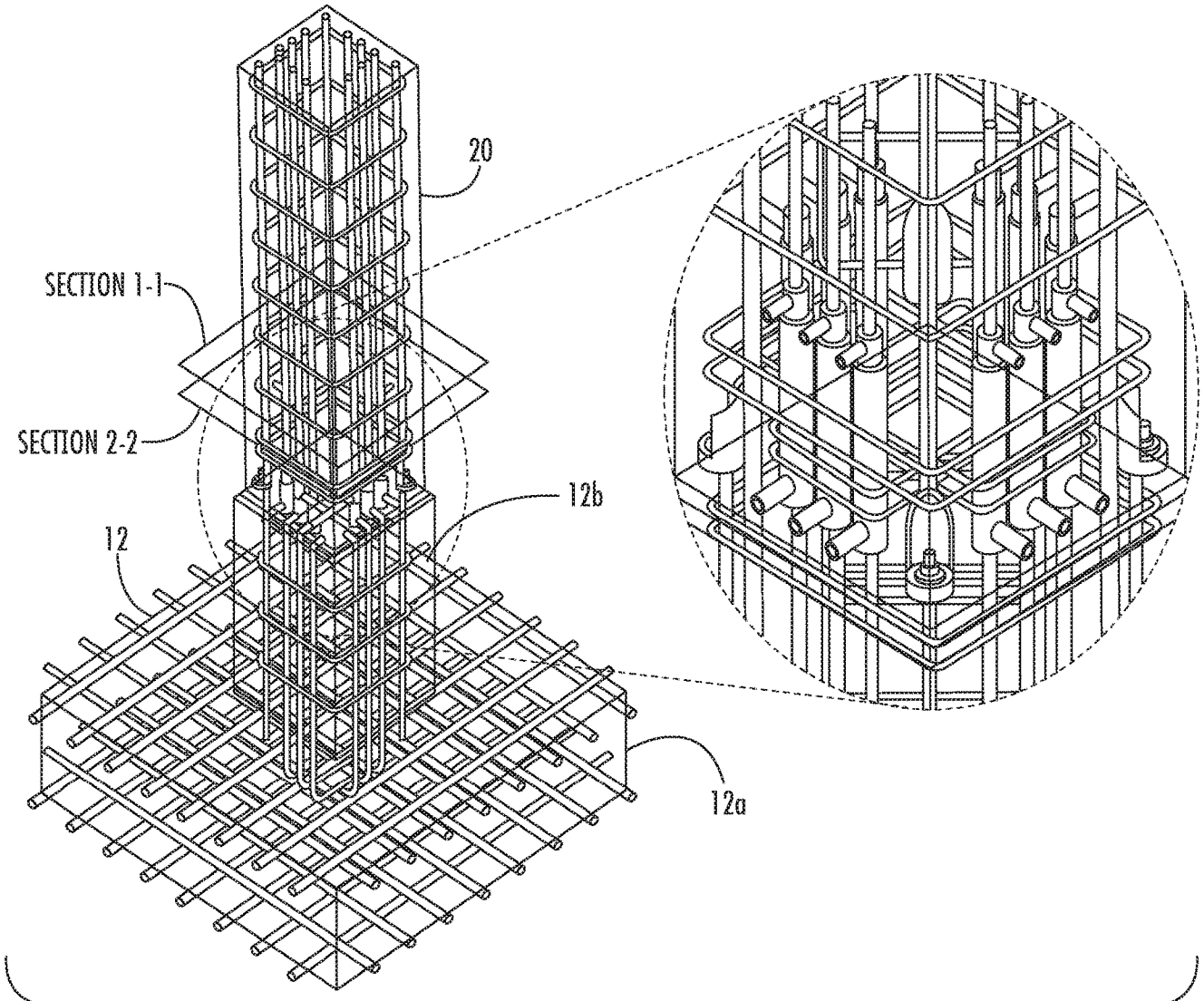
FIG. 2 illustrates a perspective internal view and a close-up perspective internal view of a connection of the column in FIG. 1 to a foundation according to one implementation.
Figure 3:
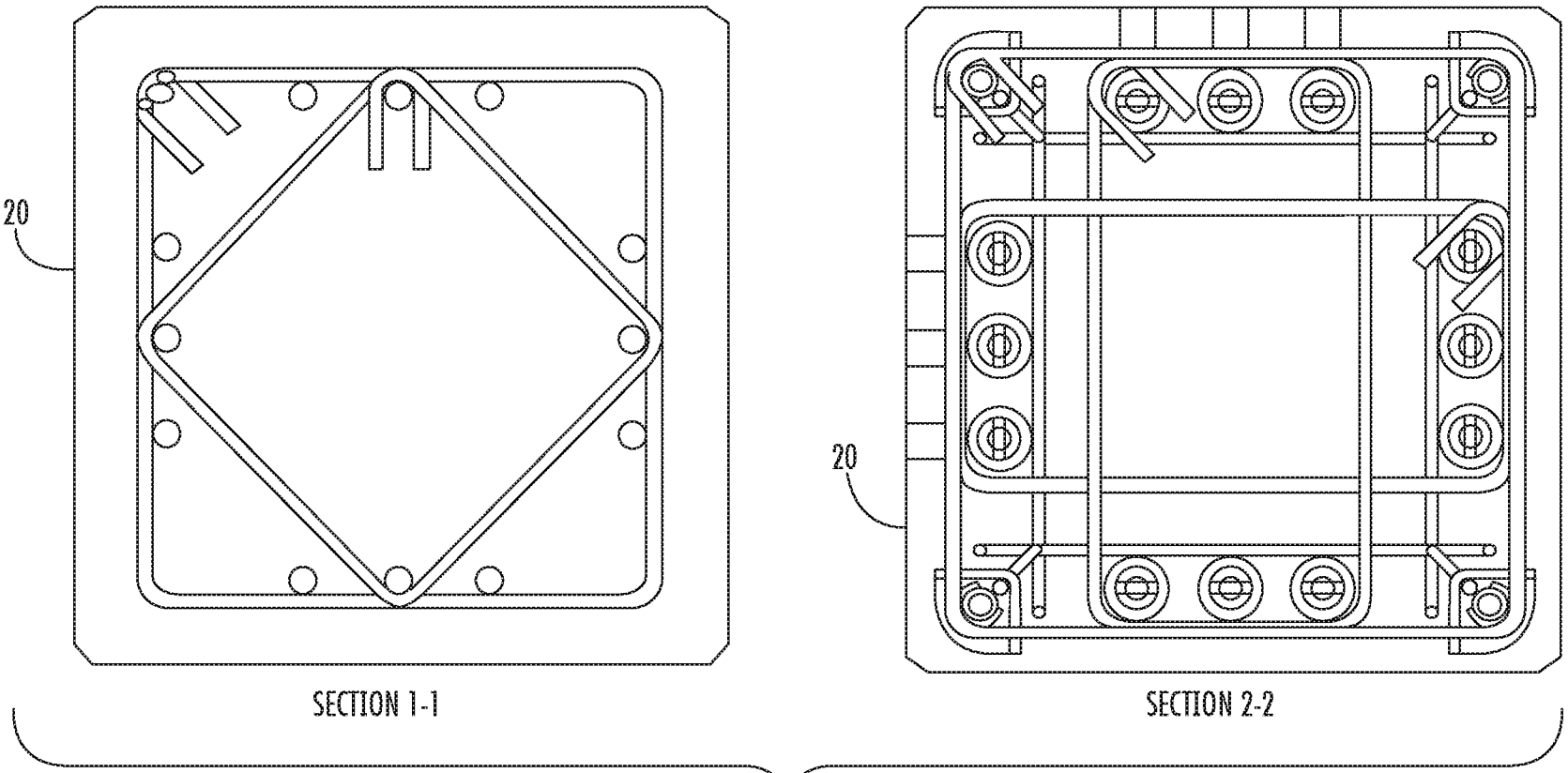
FIG. 3 illustrates cross-sectional views of the column shown in FIG. 2 from the 1-1 plane and the 2-2 plane.

Column section 20 may be connected on a bottom end thereof to a foundation 12, as shown in FIG. 2. In this example connection, the foundation 12 includes a pier 12*b* that extends upwardly from a base 12*a* of the foundation 12. However, in other implementations, the foundation 12 may not include a pier. In addition, in other implementations, other connections to a foundation are possible. Further, column section 20 may be connected to identical columns on the top and bottom to build a tall structure, with only the lowermost column section 20 connected to a foundation 12, such as shown in FIGS. 2 and 3.

Column section 20 includes one or more embedded threaded rod assemblies 22. In the implementation shown in FIGS. 1 and 4, column section 20 includes sixteen such assemblies 22 for each pair of beam sections 100 extending from opposite faces of the column section 20 at one elevation. Four assemblies 22A are arranged in a row at an upper portion of the elevation of the column section 20 and extend between two opposite faces of the column section 20, and an additional four assemblies 22B are arranged in a row at the upper portion of the elevation of the column section 20 and extend between the other two opposite faces of the column section 20. Further, four assemblies 22C are arranged in a row at a lower portion of the column section 20 at the elevation and extend between opposite faces of the column section 20, and an additional four assemblies 22D are arranged in a row at the lower portion of the column section 20 at the elevation and extend between the other two opposite faces.

Figure 6:
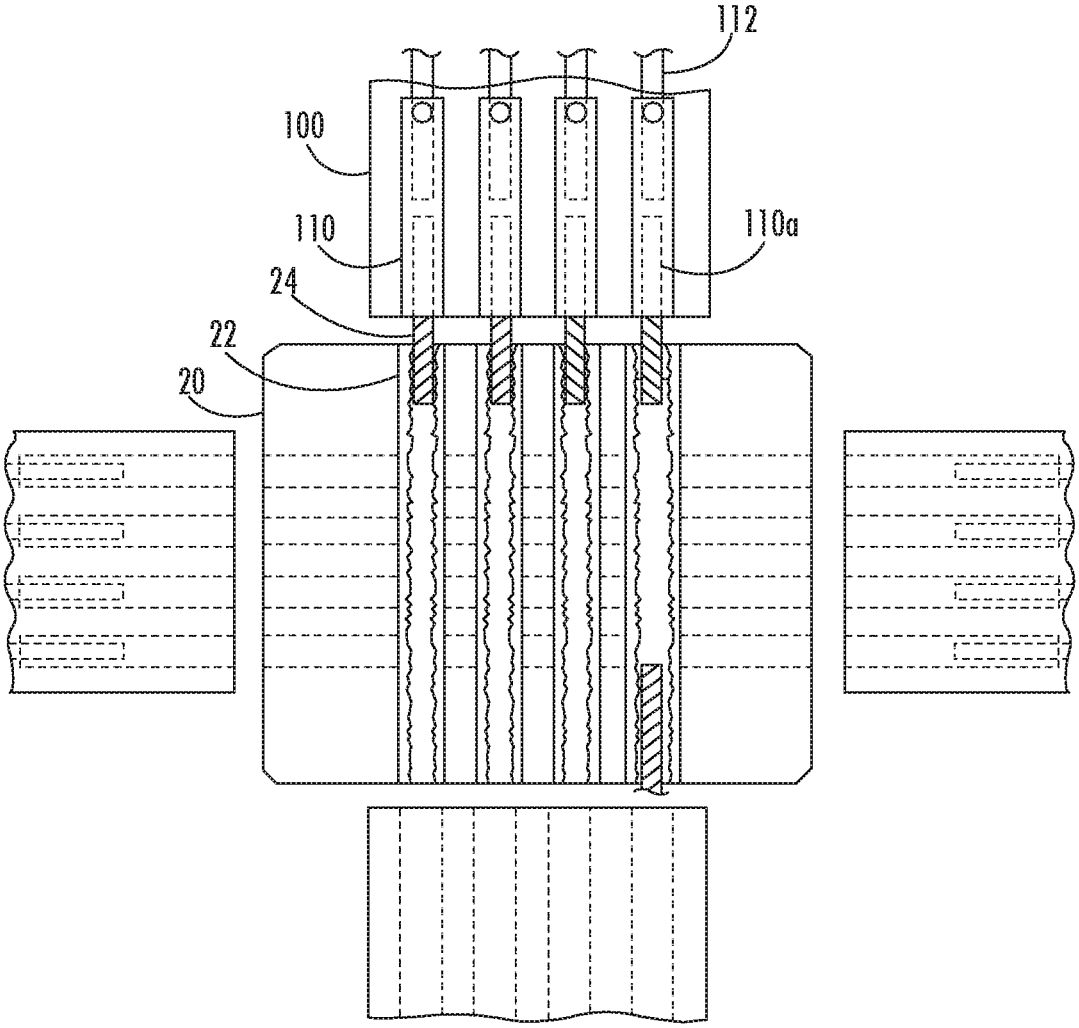
FIG. 6 illustrates a view of the assemblies in the column and beams shown in FIG. 1 through a plane that is parallel to the 1-1 and 2-2 planes shown in FIG. 2 and intersects a set of assemblies extending through two opposite faces of the column section shown in FIG. 1.
Figure 7:
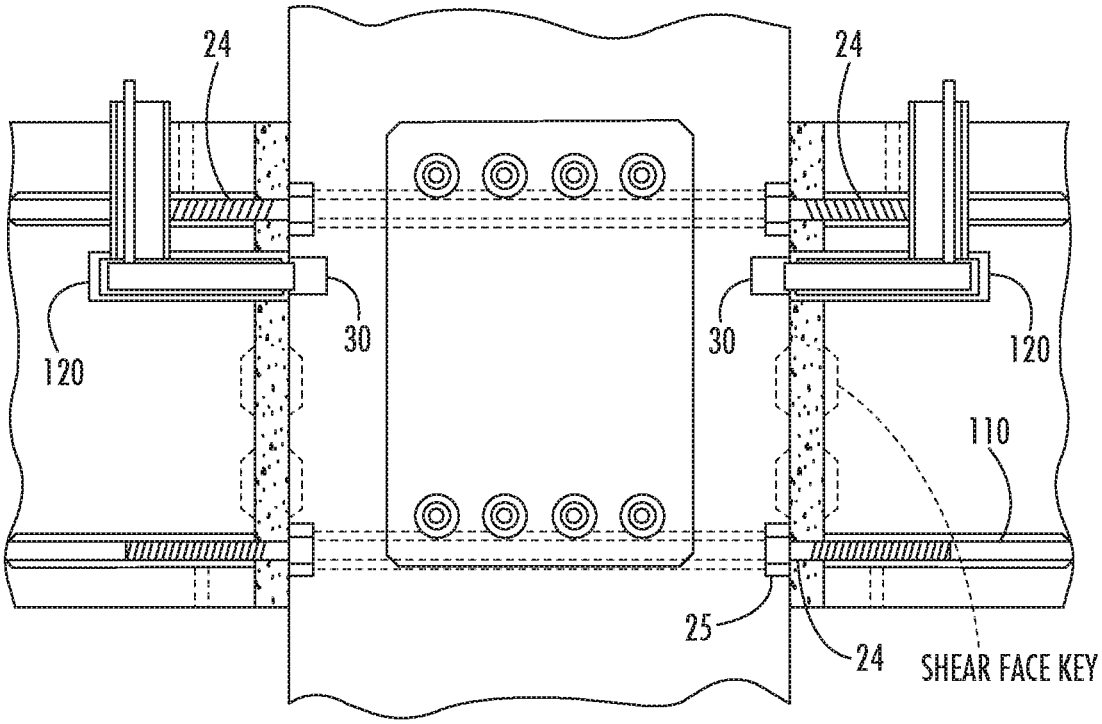
FIG. 7 shows a side view of the assemblies in the column and beams shown in FIG. 1 through a plane that is perpendicular to the 1-1 and 2-2 planes of FIG. 2 and intersects a shear lug in each beam.
Figure 8:
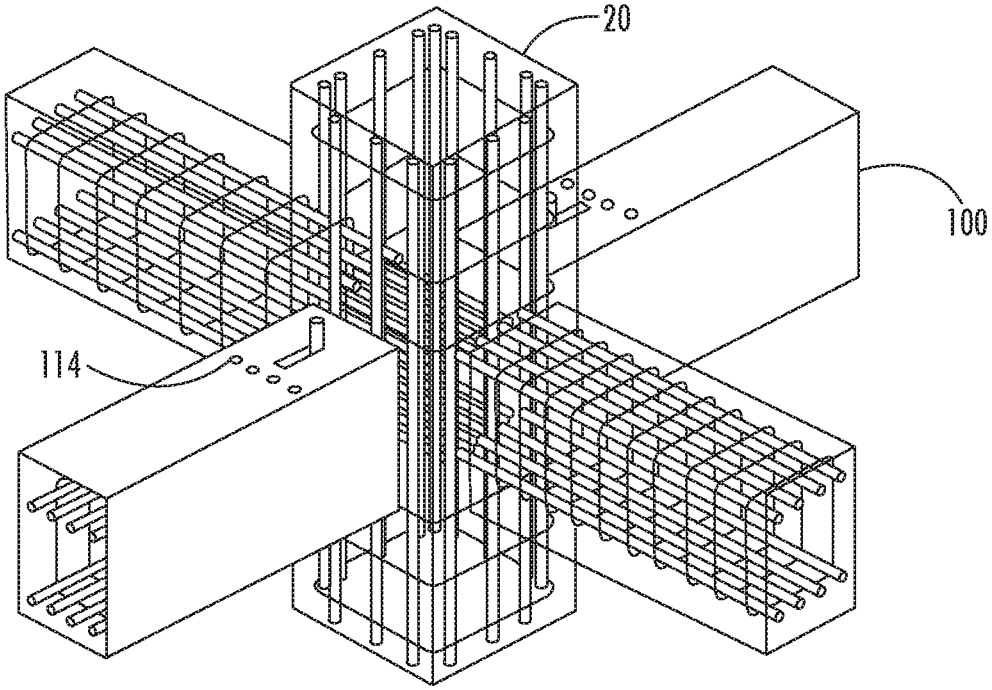
FIG. 8 shows an upper perspective view of the structure shown in FIG. 1. In this figure, an external view of two beams are shown, and an internal view of two beams and the column are shown.
Figure 9:
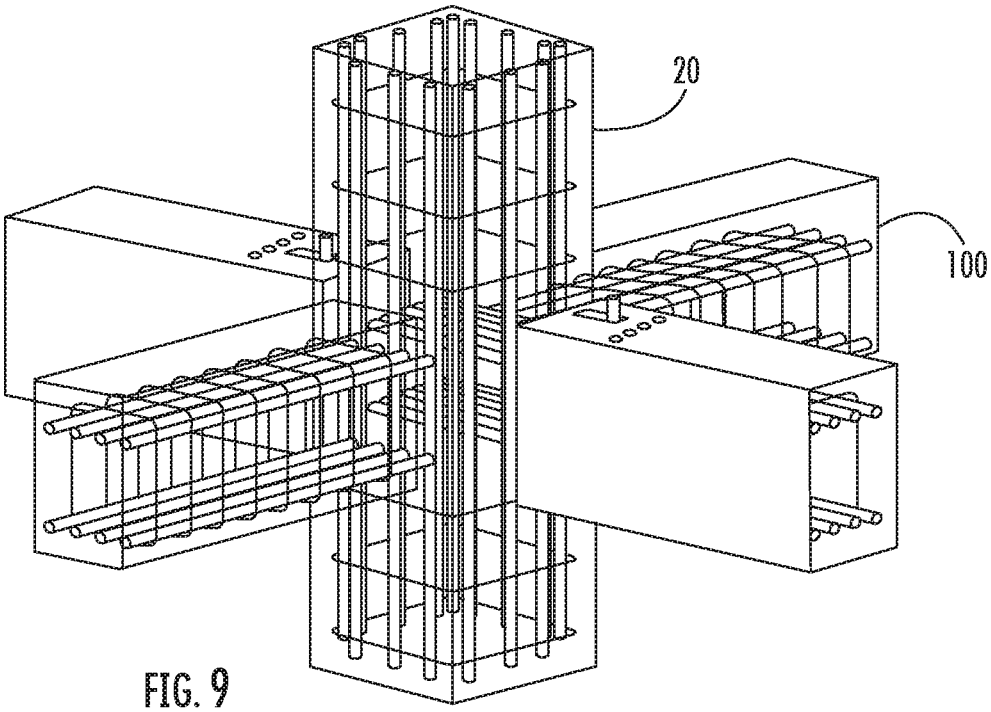
FIG. 9 shows a side perspective view of the structure shown in FIG. 8.
Figure 10:
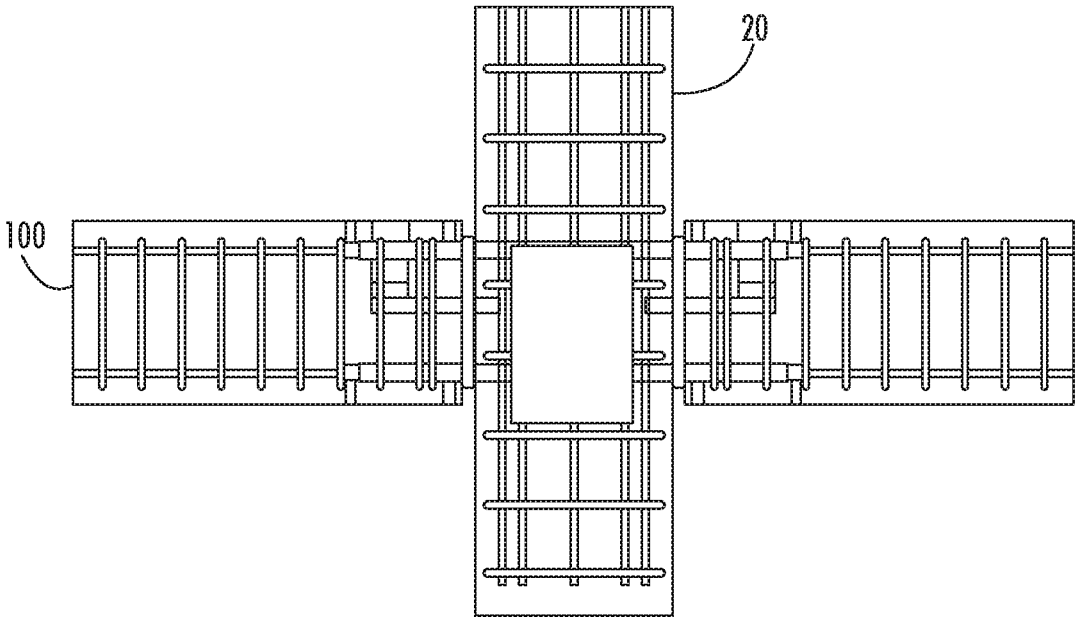
FIG. 10 shows a first side view of the beam sections and column sections shown in FIG. 8.
Figure 11:
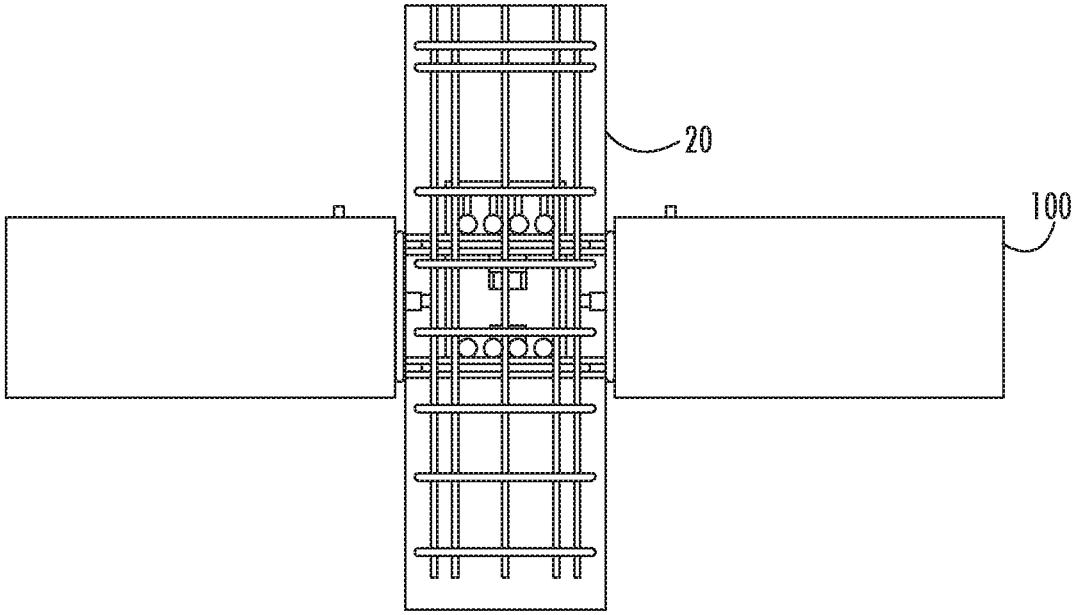
FIG. 11 shows a second side view of the beam sections and column section shown in FIG. 8. The second side view is 90° from the first side view shown in FIG. 11.
Figure 12:
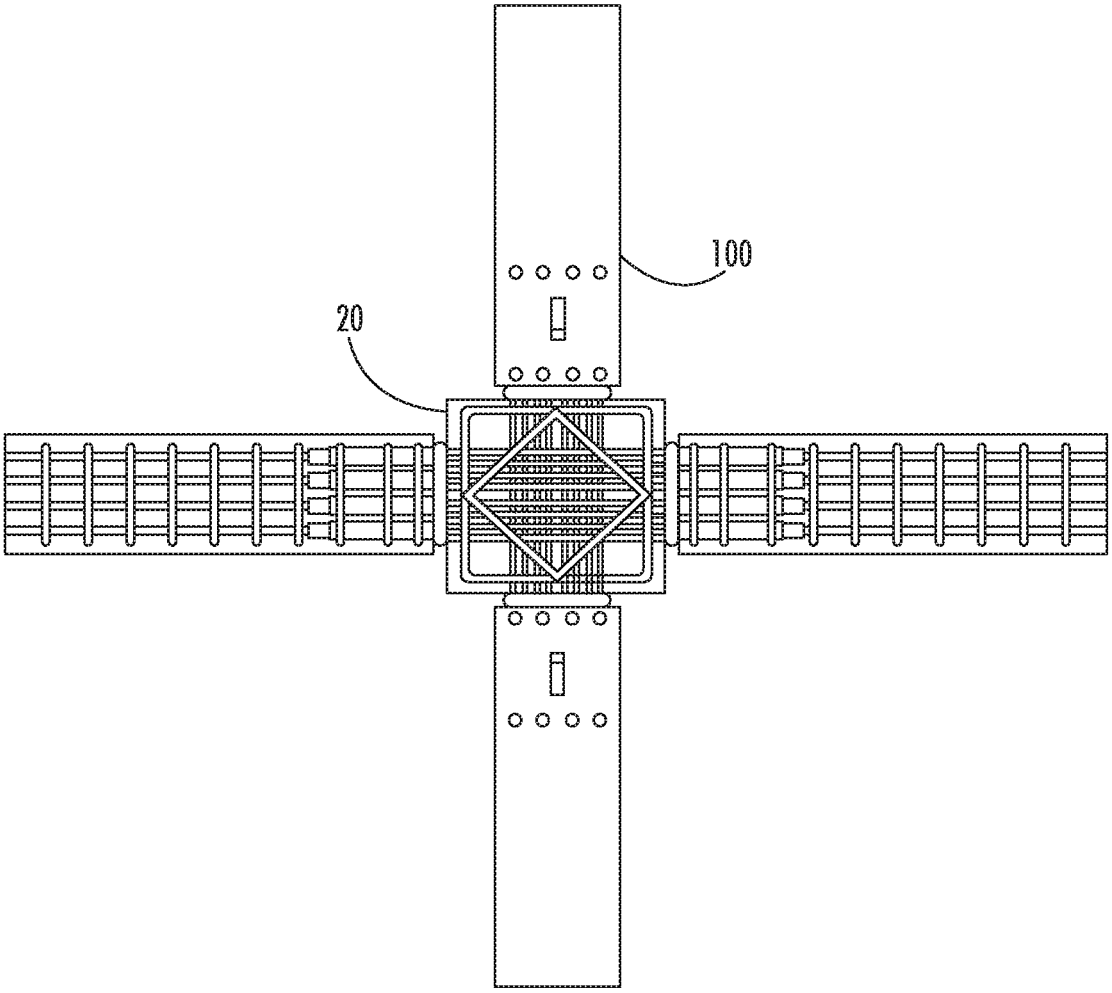
FIG. 12 shows a top view of the beam sections and the column section shown in FIG. 8.

Each assembly 22 includes at least one threaded rod 24. Each threaded rod 24 is initially contained mostly within assembly 22, but is rotated to extend out of assembly 22 in an axially outward direction and into a channel 110*a* defined in embedded assembly 110 of beam section 100 disposed axially opposite the assembly 22, as discussed below. The threaded rod 24 includes a first portion 24*a*, a second portion 24*b*, and a distal end 24*c*, wherein the second portion 24*b* is between the distal end 24*c* and the first portion 24*a*. At least the first portion 24*a* is threaded and is rotated within the assembly 22 in one direction to extend the distal end 24*c* and the second portion 24*b* axially out of the assembly 22 and into the channel 110*a* of the embedded assembly 110 of the beam section 100. In the implementations shown, the threaded rod 24 is threaded from a proximal end to the distal end 24*c*. In some implementations, a channel lock wrench or an elastic strap (e.g., rubber or polymeric elastic strap) may be used to rotate the rod 24. In addition, in implementations in which two beam sections 100 are to be coupled to opposite faces of the column section 20 at one elevation, each assembly 22 includes two threaded rods 24, as shown in FIG. 6, that extend axially outward from the assembly 22 in opposite directions toward a respective beam section 100.

Figure 15:
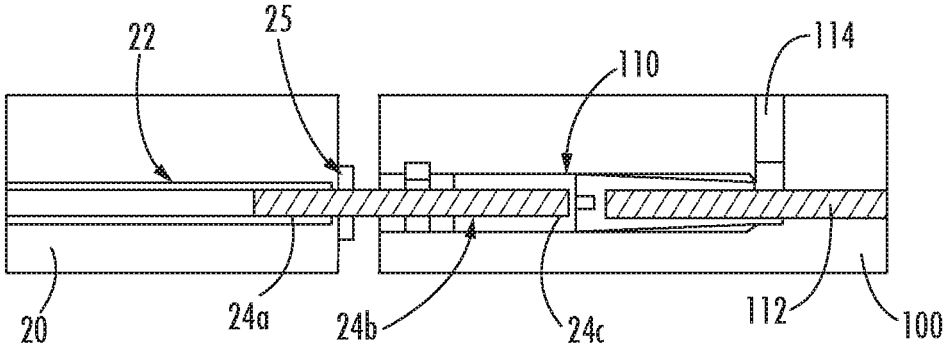
FIG. 15 illustrates a cross-sectional side view of assemblies shown in FIG. 1 embedded in a column section and beam section.

As shown in FIG. 15, the assembly 22 may also include a jam nut 25 that is threaded around each rod 24. The jam nut 25 is rotated to abut the column face to prevent the threaded rod 24 from being rotated in the opposite direction and moved axially into the assembly 22. In other implementations, the assembly 22 may include any suitable type of locknut, lock washer, or thread-locking fluid, instead of a jam nut, or one or more nuts that function as a jam nut. In addition, in some implementations, the assembly 22 may also include a hairpin that is disposed in the joint between the column section 20 and the beam section 100 around the rod 24.

Each beam section 100 includes eight embedded assemblies 110 that each define an opening at the end of the beam section 100 and a channel 110*a* extending axially from the opening to receive threaded rod 24. Each assembly 110 is coupled to rebar 112 that extends axially through the beam section 100. These rebars 112 extend the length of the beam section 100, ending at embedded assembly 110. In some implementations, an end of the rebar 112 extends into the channel 110*a* of the assembly 110. Embedded assembly 110 also includes grout port 114 to receive grout into the assembly 110 after the threaded rod 24 is rotated to extend into the assembly 110. The grout port 114 extends through the beam section 100 between an external face of the beam section 100 and the channel 110*a*. As described below, grout fills the assembly 110, which couples the rebar 112 and the threaded bar 24, which couples the beam section 100 and the column section 20.

As shown in FIGS. 4 and 5, column section 20 also defines a channel 30 which receives shear lug 121 that is movably disposed in beam section 100. Shear lug 121 can be moved into and out of a housing 120, which is embedded in beam section 100 using a handle 122. Accordingly, a method of assembling the structure of FIG. 1 is shown in FIGS. 4 and 5A-5E. First, beam section 100 is lifted adjacent column section 20 using a crane. Handle 122 is used to move shear lug 121 of beam section 100 into channel 30 of column section 20. The crane can then be disconnected, as shear lug 121 is designed to support the beam section 100 during assembly. Threaded rods 24 are then rotated until they extend into assemblies 110. Frame 200 is then assembled around at least a portion of the joint between column section 20 and beam section 100, as shown in FIGS. 4 and 5. The frame 200 may include framing members and one or more ratcheting straps for holding the framing members against the face of the column section 20. Grout is then fed (e.g., pumped and/or gravity fed) into grout ports 114 to fill the empty volume in assemblies 110 and the space (joint) between the column section 20 and beam section 100. The grout is contained by frame 200 until it dries. Frame 200 is then removed and the connection is complete.

FIGS. 1-12 show that threaded rods 24 are part of column section 20 and are extended into beam sections 100. However, in another implementation, threaded rods 24 could be part of beam sections 100 and extend into column section 20.

Figure 13:
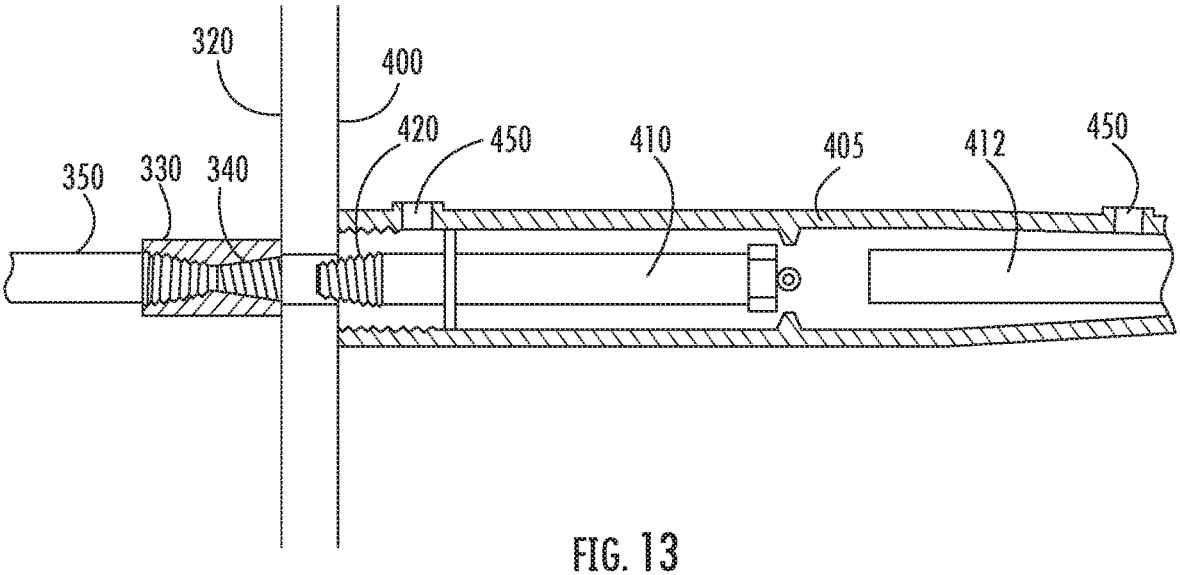
FIG. 13 shows a side view of an alternative implementation of the assemblies.
Figure 14:
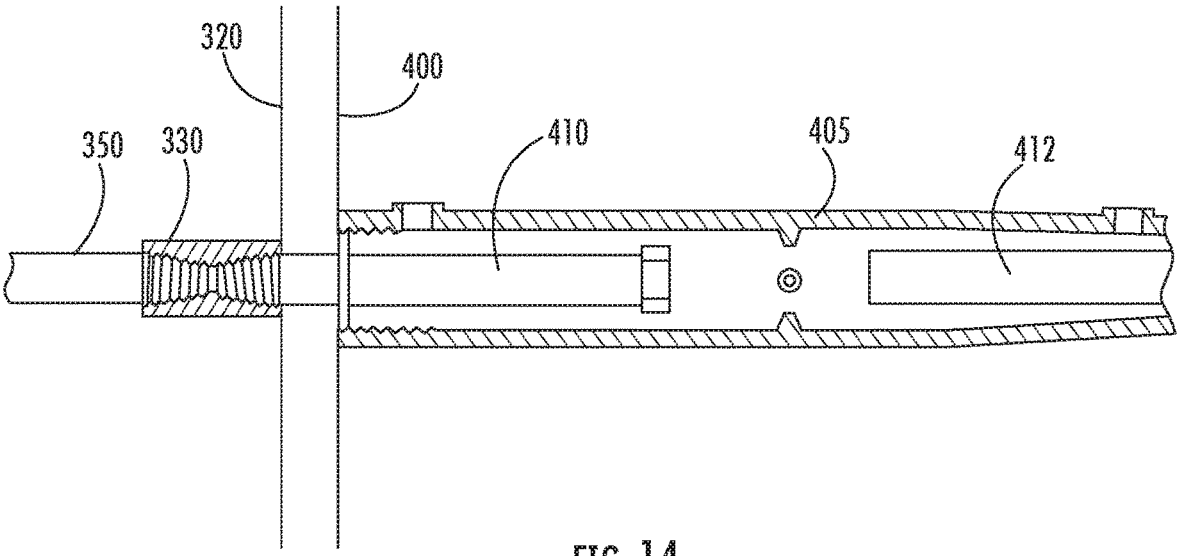
FIG. 14 shows another side view of the alternative implementation shown in FIG. 13.

In this regard, FIGS. 13 and 14 show an implementation in which threaded rods 410 are located in beam sections 400, and during assembly are rotated until they extend into threaded nut 330 in column section 320. Rebar 350 may be permanently threaded into an opposite side of nut 330 and extend to another nut 330 on an opposite side of the column section 320. Threaded rod 410 may be inside an initially hollow assembly 405 embedded in the beam section 400. Rebar 412, which extends the length of beam section 400, may extend into an end of assembly 405. Apertures 450 in assembly 405 allow an adhesive, such as grout, to be added to the assembly after the rod 410 is threaded into nut 330 to fill all the empty space in assembly 405 and fix the structure permanently.

FIGS. 13 and 14 show that rod 410 has a tapered thread 420 and nut 330 has a tapered thread 340, as opposed to the parallel threads shown in FIGS. 1-12. Either a tapered or parallel thread can be used in any of the implementations shown in FIGS. 1-14.

Figure 16:
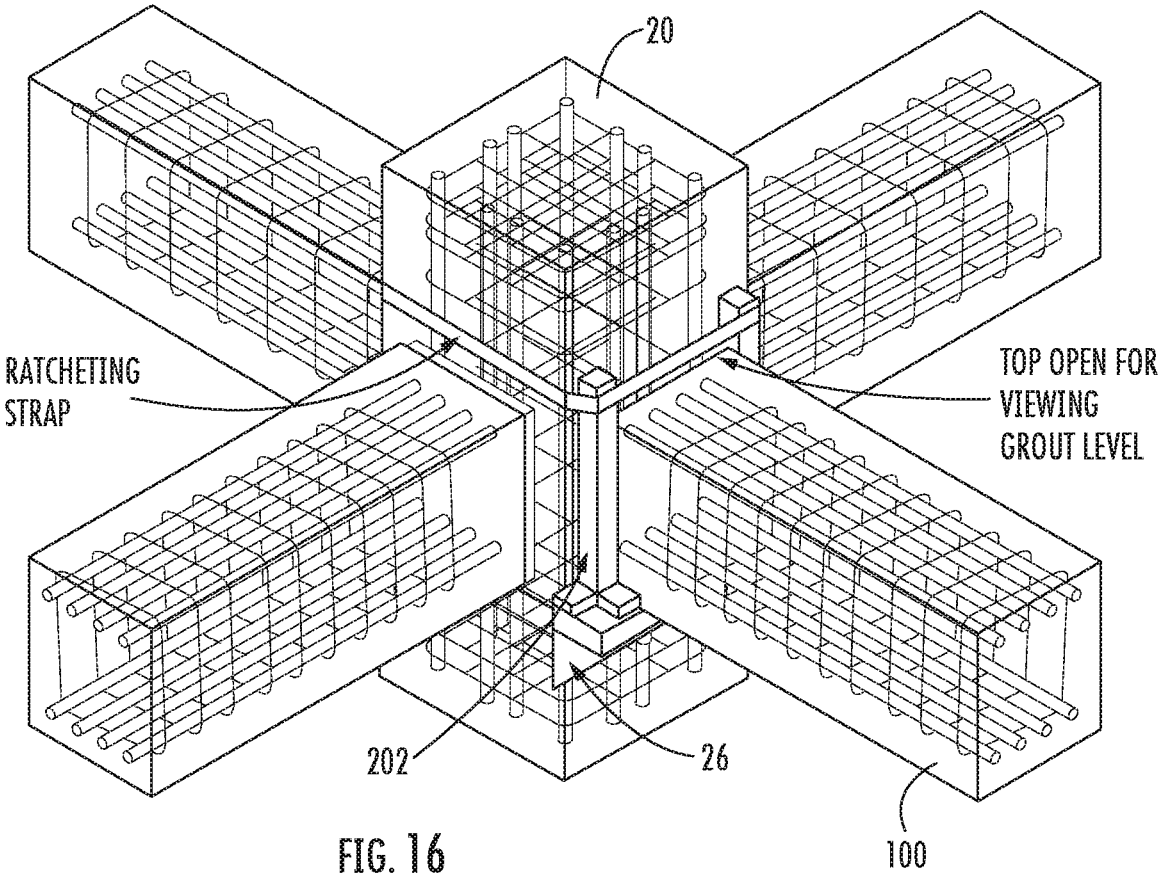
FIG. 16 illustrates a perspective view of a column section and four beam sections coupled to the column section at one elevation along with a corbel and a frame around a portion of a joint between the column section and one of the beam sections, according to another implementation.
Figure 17:
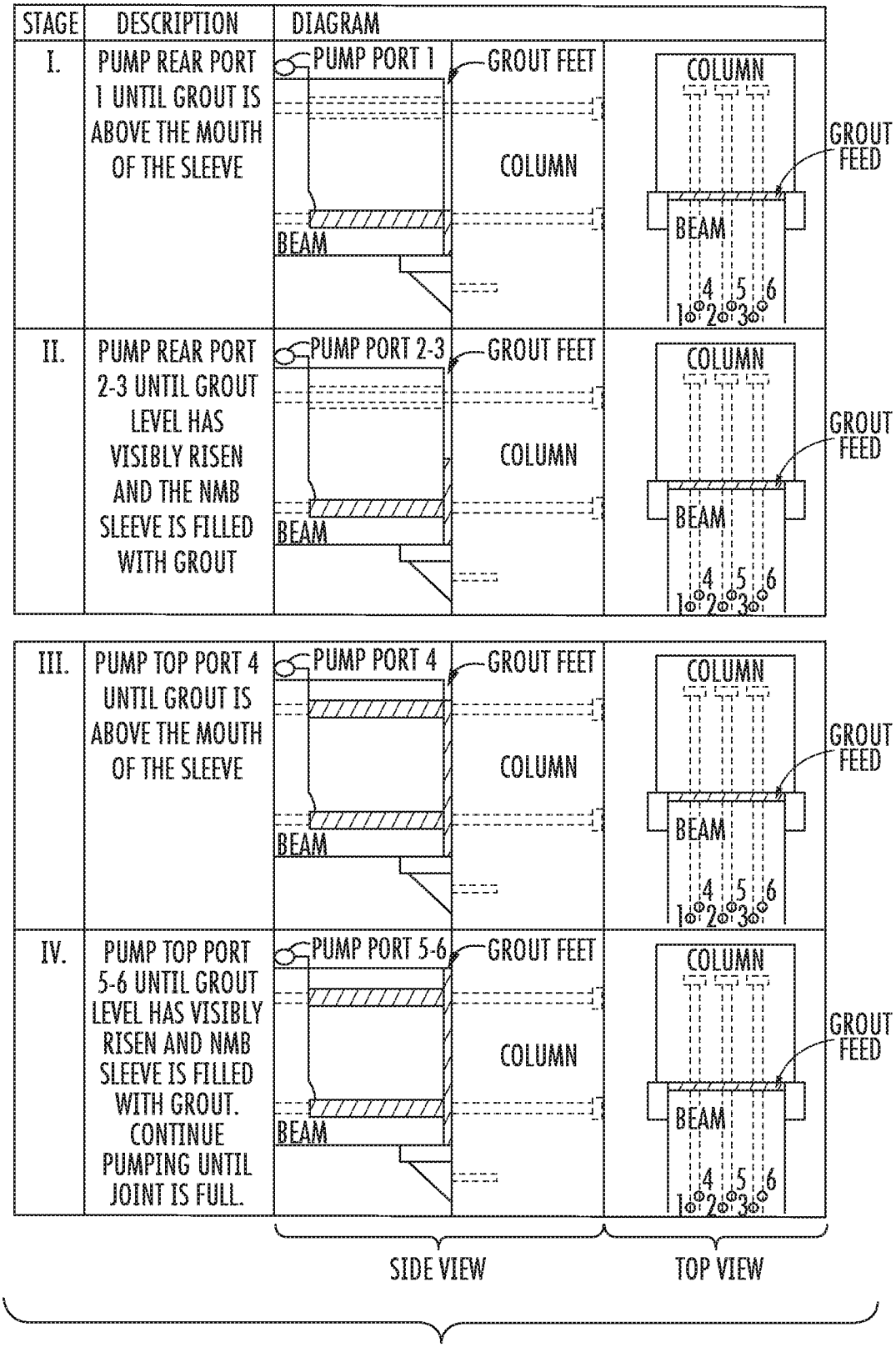
FIG. 17 illustrates a process of filling the joint and assemblies in the beam with grout, according to one implementation.

FIGS. 15-17 illustrate a method of assembling a structure according to another implementation. The method comprises providing a pre-cast concrete column section, such as column section 20 described above, having six embedded assemblies 22 with threaded rods 24 for coupling each pair of beam sections adjacent opposite faces of the column section 20, such as beam section 100 described above, to the column section 20. For example, three assemblies 22 are embedded in the upper portion of the elevation, and three assemblies 22 are embedded in the lower section of the elevation.

In addition, the column section 20 includes at least one corbel 26 coupled to one or more faces below each set of assemblies 22. The corbel 26 may be coupled to the column section 20 at the construction site or before the column section 20 is transported to the construction site. The corbel 26 may be provided in addition to or as an alternative to the shear lugs described above in relation to FIGS. 1-5E.

Next, an end of a pre-cast concrete beam section 100 is brought into close proximity to the column section 20. A lower end surface of the beam section 100 is disposed on the corbel 26. The beam section 100 includes six embedded assemblies 110 that are axially aligned with respective assemblies 22. In addition, each assembly 110 comprises grout port 114 that extends from the channel 110*b* to an external surface of the beam section 110.

As described above, the first portion 24*a* of the threaded rod 24 in each assembly 22 is rotated about the rod's axis within the respective assembly 22 until the distal end 24*c* and the second portion 24*b* of the threaded rod 24 extend into the channel 110*a* defined in the assembly 110 axially adjacent the respective assembly 22. The jam nut 25 is tightened against the face of the column section 20, and a hairpin may be placed around the rod 24 in the joint region. In some implementations, after the second portions 24*b* are disposed in the assemblies 110, the crane that lifted the beam section 100 into place is detached from the beam section 100, and assemblies 110 and shear key faces of the joint are flushed with water.

A frame 202 is then coupled around a portion of a joint between the column section 20 and the beam section 100. The frame 202 may include, for example, wooden framing members (e.g., 2×4 wood members) or framing members comprising other materials (e.g., steel). For example, the material used for the corbel 26 may be used to frame the bottom edge of the joint, and vertical legs may be coupled to the column face to complete the frame. In addition, closed cell compressible foam (e.g., pipe insulation, backer rod, foam sheet material) may be disposed between at least a portion of the framing members and the column face to prevent grout from leaking out of the joint. Furthermore, one or more ratcheting straps may be disposed around the column section 20 and frame 202 to hold the framing members against the column face. In the implementation shown, a clip or other framing members may be used to hold the bottom portion of the vertical legs in place, and the strap extends around the top portion of the vertical legs.

The frame 202 extends around the sides and the bottom of the joint, but the top of the joint is left open. Leaving this open allows for observation of the grout level and for pouring the grout into the joint. In other implementations, only a portion of the top of the joint may be left open.

After rotating the first portion 24*a* of the threaded rod 24 about its axis and connecting the frame 202 around at least a portion of the joint, the joint is grouted. In some implementations, the grouting process begins with testing the seal of the joint using water and allowing the water to drain out. Then, grout is fed into the top opening of the joint while vacuum suction is applied to at least one grout port 114. In various implementations, the grout is a high strength, non-metallic mortar, such as SS Mortar (SSM-J 2012) from SPLICE SLEEVE NORTH AMERICA, INC.

The vacuum suction draws the grout through the joint and the channel 110*a* coupled to the at least one grout port 114 and the grout port 114. This step is repeated for each grout port 114 and assembly 110. In the implementation shown in FIG. 17, the grout is fed through the lower set of assemblies 110 prior to grout being fed through the upper set of assemblies 110. The second portion 24*b* and distal end 24*a* of each threaded rod 24 are held within the respective channel 110*a* only by the grout (i.e., there is no threaded portion in the assembly 110 that engages the second portion 24*b* or distal end 24*c* of the threaded rod 24. By applying the vacuum suction to the grout port 114 during grout pouring through the joint, air voids are forced out of the assemblies 110.

The vacuum suction source may include a commercial vacuum pump and tank system, for example.

After the grout dries, the frame 202 and corbel 26 are removed. For example, the frame 202 may be removable after the grout has cured for forty-eight hours, and the corbel 26 may be removed after seven days of curing.

The present written description uses examples to disclose the present subject matter and to enable any person skilled in the art to practice the present subject matter, including making and using any devices or systems and performing any incorporated and/or associated methods. While the present subject matter has been described in detail with respect to specific implementations thereof, it will be appreciated that those skilled in the art, upon attaining an understanding of the foregoing may readily produce alterations to, variations of, and equivalents to such implementations. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

The invention claimed is:

1. A method of assembling a structure, the method comprising:

providing a pre-cast concrete column section having at least one embedded first assembly, each embedded first assembly including at least one threaded rod, each threaded rod having a first portion and a second portion, wherein the second portion is between the first portion and a distal end of the threaded rod;

bringing a pre-cast concrete beam section near the column section, the beam section having at least one embedded second assembly defining a channel for receiving the distal end and second portion of the threaded rod and at least one grout port extending between the channel and an external surface of the beam section;

rotating the first portion of the threaded rod within the first assembly until the distal end and second portion of the threaded rod extend axially into the channel defined in the second assembly;

coupling a frame around at least a portion of a joint between the column section and the beam section;

after rotating the first portion of the threaded rod and coupling the frame over the joint, feeding grout into the joint while applying vacuum suction to the at least one grout port, the vacuum suction causing grout to flow through the joint, the channel, and the grout port of the second assembly; and removing the frame after the grout dries, wherein the grout surrounds the threaded rod such that the second portion and distal end of the threaded rod are held within the channel only by the grout.

2. The method of claim 1, wherein the second assembly is coupled to a rebar extending axially through the beam section.

3. The method of claim 1, further comprising coupling a corbel to the column section prior to bringing the beam section in close proximity to the column section, and setting a lower face of the beam section onto the corbel prior to rotating the threaded rod of the first assembly.

4. The method of claim 1, wherein the column section includes two or more first embedded assemblies and the beam section includes two or more corresponding embedded second assemblies that are axially alignable with the first assemblies.

5. The method of claim 1, further comprising coupling a lower portion of the column section to a foundation prior to bringing the beam section in close proximity to the column section.

6. The method of claim 1, further comprising coupling a lower portion of the column section to an upper portion of another column section prior to bringing the beam section in close proximity to the column section.

7. The method of claim 1, wherein the beam section is a first beam section and is brought in close proximity to a first face of the column section, and the method further comprises bringing a second beam section in close proximity to a second face of the column section, the second face being opposite and spaced apart from the first face.

8. The method of claim 7, wherein the threaded rod is a first threaded rod extendable from a first end of the first assembly in a first axial direction into the channel of the second assembly of the first beam section, and the first assembly further comprises a second threaded rod extendable from a second end of the assembly in a second axial direction into the channel of the second assembly of the second beam section, wherein the first and second axial directions are opposite each other.

9. The method of claim 1, wherein the beam section is a first beam section and is brought in close proximity to a first face of the column section, and the method further comprises bringing a second beam section in close proximity to a second face of the column section, the second face being adjacent to the first face.

10. The method of claim 1, wherein the beam section includes a shear lug, and the method further comprises extending the shear lug into a channel defined in the column section.

11. A system for assembling a structure, the system comprising:

a pre-cast concrete column section, the pre-cast concrete column section including an embedded first assembly with at least one threaded rod, each threaded rod having a first portion and a second portion, wherein the first portion is rotatable within the embedded first assembly to extend the second portion of the threaded rod out of the embedded first assembly;

a pre-cast concrete beam section comprising an embedded second assembly defining a channel for receiving the second portion of the threaded rod and at least one grout port, the at least one grout port extending from the channel to an external face of the beam section; and a frame extending around at least a portion of a joint defined between the column section and the beam section, the frame defining an opening along an upper edge of the beam section, wherein:

the at least one grout port is couplable to a vacuum suction source for applying vacuum suction to the grout port to urge grout poured into the opening of the frame to flow through the joint and through the second assembly and into the grout port, and the grout surrounds the threaded rod such that the second portion of the threaded rod is held within the channel only by the grout and does not engage any threaded structure within the channel.

12. The system of claim 11, wherein the second assembly in the beam section is coupled to a rebar in the beam section.

13. The system of claim 11, wherein the beam section includes a shear lug configured to be inserted into a channel defined in the column section.

14. The system of claim 11, wherein the column section includes two or more first assemblies, and the beam section includes two or more corresponding second assemblies defining channels for receiving the threaded rods.

15. The system of claim 11, wherein a lower portion of the column section is connected to a foundation.

16. The system of claim 11, wherein a lower portion of the column section is connected to another column section.

17. The system of claim 11, wherein the beam section is a first beam section coupled to a first face of the column section, and the system further comprises a second beam section coupled to a second face of the column section, wherein the first face is opposite and spaced apart from the second face.

18. The system of claim 17, wherein the threaded rod is a first threaded rod extendable from a first end of the first assembly in a first axial direction into the channel of the second assembly of the first beam section, and the first assembly further comprises a second threaded rod extendable from a second end of the assembly in a second axial direction into the channel of the second assembly of the second beam section, wherein the first and second axial directions are opposite each other.

19. The system of claim 11, the beam section is a first beam section coupled to a first face of the column section, and the system further comprises a second beam section coupled to a second face of the column section, wherein the first face is adjacent to the second face.

* * * * *